US005982801A

United States Patent [19]

Deak

[11] Patent Number: 5,982,801

[45] Date of Patent: Nov. 9, 1999

[54] MOMENTUM TRANSFER APPARATUS

[75] Inventor: David Deak, New York, N.Y.

[73] Assignee: Quantum Sonic Corp., Inc, New York, N.Y.

[21] Appl. No.: 08/658,508

[22] Filed: Jun. 10, 1996

Related U.S. Application Data

[63] Continuation-in-part of application No. 08/274,747, Jul. 14, 1994, Pat. No. 5,525,041.

[51] Int. Cl.[6] ..... H01S 3/14

[52] U.S. Cl. ..... 372/69; 372/57; 372/92; 372/39; 372/5

[58] Field of Search ..... 372/92, 69, 39, 372/72, 98, 5, 57

[56] References Cited

U.S. PATENT DOCUMENTS 3,743,446 7/1973 Mandroian .
4,808,084 2/1989 Tsoubouchi et al. .
4,875,214 10/1989 Denne ..... 372/92
5,020,977 6/1991 Lucas .
5,263,341 11/1993 Lucas .

OTHER PUBLICATIONS

Suplee; "Searchingfor Nature's Message in a Bottle of Glowing Water"; Science; p. 1.

*Primary Examiner*—Leon Scott, Jr.

[57] ABSTRACT

Apparatus providing ultrasonic control of a fluid medium to provide selective motion and cavitation comprising a transducer and an associated chamber providing a controllable acoustic travelling wave therein. The chamber includes an inlet, an outlet and a tapered passage through which the liquid medium flows and/or cavitation is induced and/or controlled. Embodiments of the present invention provide the production of light by controlled sonoluminescence and the generation of electrical energy by the flow of a medium through a magnetic field.

7 Claims, 10 Drawing Sheets

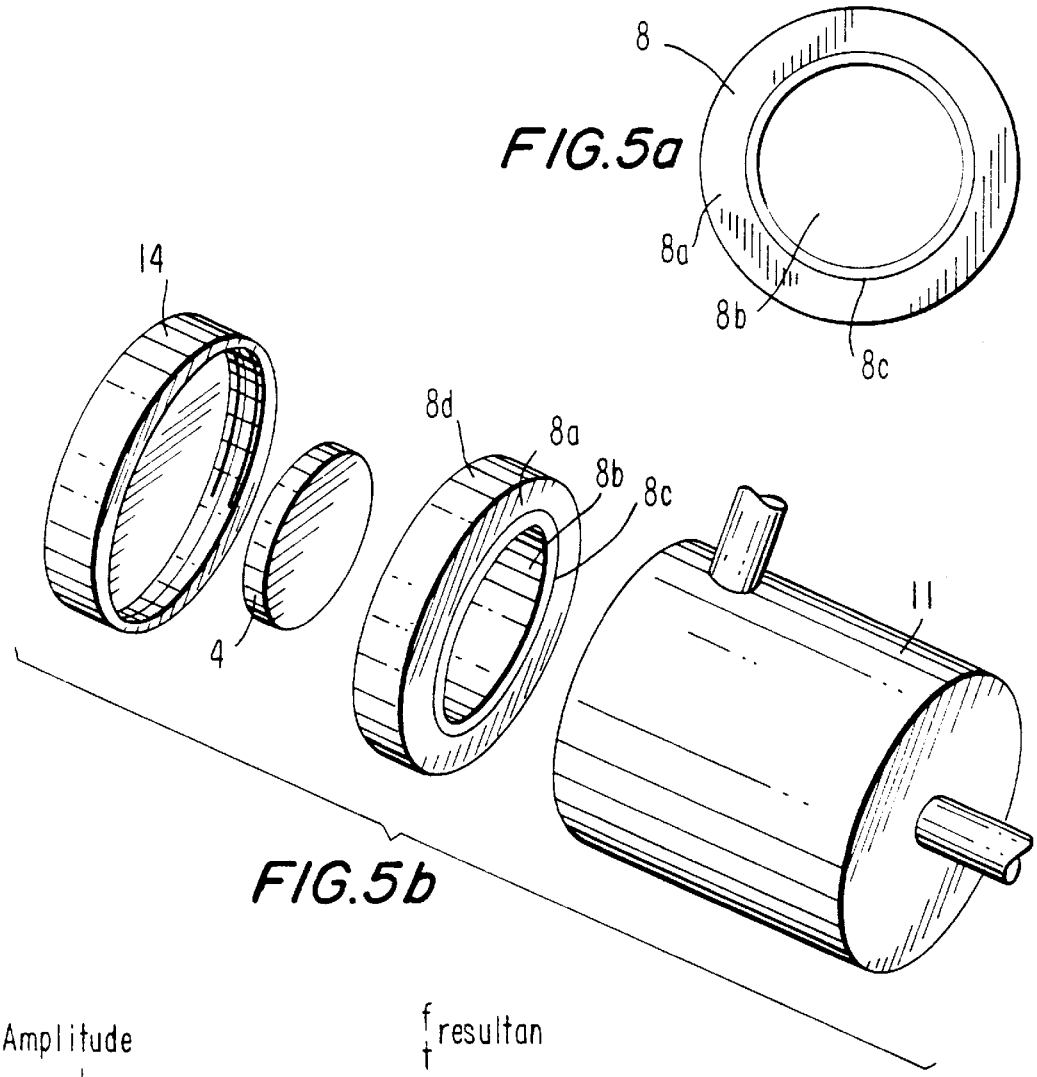
FIG.5a
FIG.5b
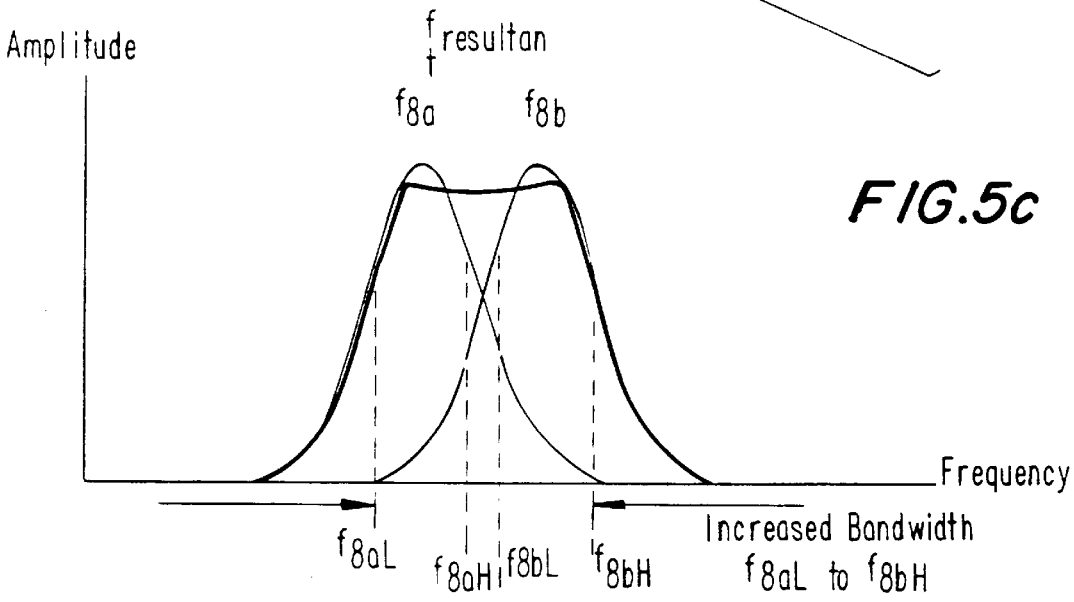
FIG.5c 2a
1a
9
11a
7a
8a
5a
10
3a
+
-
6a
4a
4b
-
3b
+
6a
10
5b
8b
1b
11b
7b
2b 2a
1a
9
11a
7a
8a
5a
10
3a
+
-
6a
4a
9
4b
6b
-
+3b
5b
10
7b
11b
1b
8b
2b

MOMENTUM TRANSFER APPARATUS

This application is a continuation-in-part of application Ser. No. 08/274,747 U.S. Pat. No. 5,525,041 entitled Momentum Transfer Pump by David Deak, filed Jul. 14, 1994.

FIELD OF THE INVENTION

This invention relates to apparatus for providing ultrasonic control of a fluid medium, including liquids, liquid metals, gases or aerosols, as well as control of cavitation-induced regions such as micro-bubbles and vapors, which may further result in the selective emission of energy. Furthermore, the apparatus of the present invention is applicable to the generation of energy resulting from the motion of the fluid medium, such as through an externally applied magnetic field.

BACKGROUND OF THE INVENTION

The two categories of electromechanical pumps namely; force and compression pumps all require moving parts for proper operation and in some special way these parts are designed in relation to the amount of fluid to be pumped per unit time and further the overall volume of the physical pump design. Compression pumps known as Positive displacement types are capable of generating great pressure, nevertheless require many moving parts such as a piston, piston rod, crankshaft, and associated valve assemblies. Positive displacement constriction pumps are the safest; mainly because the pumped fluid never contacts an environment different than its internal tubing. They are for this fact used widely in the medical and pharmaceutical sector where the prevention of contamination is a vital factor. Their major disadvantage lies in the possible crushing forces upon the material being pumped if the tubing constricts completely. The moving parts required therein wear out from the fatigue caused by continuous operation.

There is for consideration the operation of prior art relating to sonic and ultrasonic pumps that feature as an embodiment using acoustic standing waves for their principle of operation. Specific references are to the patents of: Mandroian U.S. Pat. No. 3743,446, Lucas U.S. Pat. No. 5,020,977, and Lucas U.S. Pat. No. 5,263,341.

Referring to the Mandroian patent, it uses a source of sound from a fluctuating diaphragm or piezoelectric transducer that oscillates at a preselected frequency. The frequency of oscillation of the diaphragm piezoelectric transducer and the length of the pump chamber are configured together so that this arrangement forms a resonant cavity (chamber) where acoustic standing waves are established in the fluid which allows for a pressure node or antinode at the wall opposite the diaphragm piezoelectric transducer. A series of pressure nodes and antinodes are distributed along the length of the chamber, and the number of nodes and antinodes depending upon the length of the chamber and the frequency of vibration of the diaphragm piezoelectric transducer.

Mandroian further describes that the entrance port for the fluid is located in the chamber at one of the pressure nodes and an exit port is located at one of the pressure antinodes. This embodiment requires that a resonant condition must be created before any pumping action occurs and further, it is critical to have the dimensions of the chamber such that the entrance and exit ports are precisely on the nodes and antinodes for proper operation. This proper operation relies heavily on frequency resonant conditions within the chamber; if for any reason there is a frequency shift, then the efficiency of operation is decreased.

Furthermore if there is any alteration of the chamber design dimensions, then it will result in an operational compromise.

In addition, since resonant standing waves are required for proper operation, and if these standing waves are changed for any reason and become traveling waves, either continuously or discontinuously or by slight variations around the vicinity of the ports due to phase shifting, then the operation is again compromised.

Also where the waves emitted from the diaphragm or piezoelectric transducer become distorted for any reason, if for example the wave changes from a sinusoidal wave to a complex wave with harmonics, then these harmonics have to be realized as having a recognizable effect upon the overall efficiency of the pump's operation.

There are frequency limitations connected with some of the design features of such pump and that in many instances, these limitations as discussed below could limit the pump's various applications. In general, if the frequency chosen is too low, then size could be a problem, for it is required for efficient operation that within the chamber at least one wave length be given to the chamber dimension. Even if a half-wavelength or quarter-wavelength is used as a physical dimension, there are certain disadvantages to these configurations relating to efficiency of operation. If the frequency utilized is too high, then the fluid could absorb the wave energy and attenuate the standing waves thus effecting overall operation. Accordingly this pump design does not provide efficient reliable pump operation under all conditions.

Referring to the Lucas patents, in both patents the theory of operation and so with the basic embodiment of both patents acknowledges the objective of using a gas in the resonant chamber (cavity) and not a liquid, the later of which is not achievable.

The compressors used in both Lucas' patents likewise utilize embodiments which use standing waves of acoustic pressure for creating nodes which are periodic points of minimum pressure and antinodes which are periodic points of maximum pressure. The standing wave phenomenon of course requires a resonant state for proper operation so as with these compressors of the Lucas patents.

These compressors require that a very narrow resonant operational frequency range be utilized by way of special electronic control circuitry. This control circuitry includes microprocessor controlled phase locked loops to insure frequency stability, thus adding to the complexity of the design. Such control circuitry is necessary for such a complex compressor system used for refrigeration.

The essense of Lucas' compressors, require the creation of a standing wave within a resonant chamber or cavity, and further attempting to maintain the standing wave with its fixed periodic nodes and antinodes of pressure. These nodes and antinodes are required to be precisely located at the entrance and exit fluid ports, for the purpose of moving a gaseous refrigerant one way into a heat exchanger, where the excess heat generated from compression is carried off and the gaseous refrigerant is thereby cooled to a liquid phase. This cooled liquid is then passed through a volume that contains a number of ingredients to be cooled—such as food, etc. After the heat of the food or whatever, is passed to the liquid, it (the liquid) heats up and expands into the gaseous phase once more; only then- to reenter the resonant chamber of the compressor to begin the cycle all over again.

In order to accomplish this task, the internal mechanism of the compressor requires a longitudinal standing wave and that such wave must be transverse to the exit and entrance ports. This mechanism is further established by action of streaming effecting the overall efficiency of such compressors by taking away energy from the wave. This streaming effect occurs when the very same pressure differentials that allow for transverse gaseous flow between exit and entrance ports, are of sufficient amplitude to cause a gaseous flow between the nodes and antinodes within the resonant chamber. This results in a continuous forth and back gaseous flow between the nodes and antinodes and sets up a net flow impedance (a complex restriction to fluid flow) to the main flow to the port or ports. Streaming is similar to hydrodynamic eddy currents in fluids or electrical eddy currents in electrical transformers, etc. Decreased efficiency in overall operation is a result of such effect. Since the internal mechanism of these compressors is a longitudinal standing wave and that this wave is transverse to the exit and entrance ports. Accordingly the operation of the compressors is dependent upon the transverse or shear wave component of the standing wave. It is this transverse component that allows for the initialization of the gaseous flow into the exit port by means of a wave gradient from the entrance to the exit ports.

Another feature of the compressors of Lucas' patents is the use of one or more ultrasonic drivers which emit periodic ultrasonic energy which may or may not be linear in nature. It is stated that the frequency of the transducer is above the standing wave frequency. It is then asserted that the energy is demodulated into pulses of complex waves, and that this is accomplished by the higher frequency components being attenuated by the gaseous environment. What is left then, is a pulsed complex wave with lower frequency components; some of which fall into the frequency range of the standing wave frequency and add energy thereto.

Additionally, the Lucas patents states that an ultrasonic transducer can be used in a non resonant pulsed or modulated mode. "Non resonant mode" meaning that the frequency of the transducer is not equal to the frequency of the standing acoustical wave. In this pulsed or non resonant mode, several items need further clarification: the transducer operates at its resonant mode and "that" mode is much higher than the standing wave frequency by design. The transducer is switched on and off to create a succession of short pulses; each pulse consists of a short train of high frequency oscillations. The high frequency components of this pulse train are absorbed or attenuated by the gaseous medium and the lower frequency components falling within the range of the standing wave frequency will provide the necessary mode of operation. This is in effect overdrives the transducer crystal, creating nonlinear effects and complex waves leading to Fourier components of many frequencies, some of these being that of the standing wave frequency.

It is also suggested that a multiplicity of transducers be placed in contact at the nodes and antinodes as such placements would allow energy to be added to the standing wave at various points. No doubt energy would be added, moreover the energy coefficient of transducers is less than unity, the overall effect is like placing a group of transducers in parallel, their energy minus the losses are additive therefore the same could be accomplished by using one transducer comparable in energy to all of their additive energies.

In view of the above discussion, the following points can be assessed with regard to the devices disclosed by the Mandroian and Lucas prior art patents:

1. Acoustic standing waves are the primary mode of operation of the prior art. Furthermore the standing waves are built up to their maximum value (taking into consideration system losses) after the generation of a traveling wave from a transducer or other source of acoustic energy. Further, this maximum value assigned to the standing wave is sustained only by the constant acoustic energy injected into the system through the transducer element.

2. A gaseous fluid is the medium of choice for the compressors of Lucas' in order to function properly as a refrigeration compressor.

3. The actual gaseous fluid flow is transverse to the acoustic standing wavefront.

4. Precise geometry of the chamber is essential for successful operation requiring a resonant mode for the chamber; and additional electronic control measures are required to provide frequency compensation circuitry; such as phase locked loops that adjusts for frequency drift above and below the resonant mode of the chamber.

5. The Lucas compressors can utilize a multiplicity of acoustic energy sources situated at any one or all of the acoustic generated pressure nodes and antinodes, for the purpose of feeding additional energy at these points to increase the overall system efficiency.

Moreover, ultrasonically induced light from or within a liquid called sonoluminescence, is generally described by the work of others, such as by Cambridge University theoretical physicist, Dr. Claudia Eherlein; Phys. Rev. A Sol. 53 (1996) p 2772; and Phys. Lett. May 6. Other researchers involved in this field of sonoluminescence generation have up until Dr. Eberlein's novel theory, been at a loss for explaining the mechanism behind this (sonoluminescence) phenomenon. Prior art displayed by the work of these researchers such as Dr. Seth Putterman indicate that until now, the practical approach for generating sonoluminescence was to transmit non-focused ultrasound into a container of water, and using a fixed frequency continuous wave of 10 or 20 kHz., with an amplitude of ultrasound sufficient enough to cause cavitation expansion and collapse of a single vapor bubble injected into a region of the container that was in the direct path of the non-focused ultrasound. The prior art investigation and research currently uses ultrasonic single frequency transducers and unfocused ultrasonic waves. Without a good working theory on the mechanism behind sonoluminescence, prior art investigation is limited in controlling and directing the sonoluminescence for any widespread practical applications.

SUMMARY OF THE INVENTION

This invention provides apparatus and methods for controlling several fundamental and highly significant features and attributes pertaining to the mechanism underlying the phenomenon of sonoluminescence. The present invention also provides apparatus and methods for production and control of sonoluminescence in both vapor and gas cavitation. With this in consideration, a more general theory of cause is required to explain this effect. Among liquids generally, the amount of light emitted appears to increase with the product of the electric dipole moment and the viscosity of the liquid involved.

If the momentum transfer apparatus is utilized in a 'non-pump' mode of operation, then with the application of a complex pulse waveform superimposed upon a continuous sinusoidal waveform which is applied to excite the ultrasonic transducer; cavitation will occur. This cavitation will be established at the focal point length of the parabolic multiband transducer which is designed to reside near the end most opposite the transducer source. When cavitation occurs and when the cavitation is stimulated by a continuous wave or pulsed waves of sufficient repetition rate, sonoluminescence will take place as a direct reaction to the ultrasonic stimulus.

According to the present invention, a source of coherent blue or other spectral light results from using the ultrasonic momentum transfer pump in a special 'non-pump' mode of operation. Also, a source of coherent blue light or other spectral light results from a procedure of using a small droplet of liquid water or some other such combination of water or heavy water which is ultrasonically levitated by means of an ultrasonic levitation device as described by Deak in an article published in Infinite Energy Magazine vol. 1 No. 4 1995 titled "Applications for an Acoustic Levitation chamber" incorporated by reference. (Also in the proceedings of the First Trabzon International Energy and Environment Symposium held in Trabzon, Turkey; Jul. 28 to 31, 1996.)

Further additional objects and advantages of the invention are:

- to provide a pump with no moving parts which makes use of longitudinal momentum transfer from acoustic radiation pressure exerting a longitudinal force upon the molecular structure of the medium (fluid),
- to provide an optional ultrasonic transducer arrangement using either a single frequency range or a broadband frequency range using a special design configured transducer,
- to provide pumping action not requiring a resonant pump chamber, thereby eliminating numerous special arrangements inherent with such resonant pump designs,
- to provide a pump with complete isolation of the medium from the outside environment, to provide a pump with one chamber or a multiplicity of chambers for complex pumping arrangements, to provide a pump with one transducer or a multiplicity of transducers for complex pumping arrangements,
- to provide a pump with various frequency selections from a broadband ultrasonic transducer to accommodate various fluids to be pumped,
- to provide a pump usable at high frequencies (i.e. 1 MHz),
- to provide an ultrasonic pump without requiring a resonant mode for operation thus eliminating complex control circuitry for basic operation,
- to provide a method of creating a focused zone for establishing greater energy densities within the medium for imparting larger values of momentum to the medium thus enhancing pumping action, and thereby providing with this focused zone a well defined volume of the medium which will produce cavitation; which if the cavitation is collected at the opposite end of the chamber and if that medium is water, the cavitation will subsequently produce sonoluminescence and if the output port is modified to prevent the flow of fluid, cavitation will collect at this closed port and the result will be a source of stimulated blue light energy; making for a blue water laser source.

In accordance with the broadest embodiment of the present invention, a pump is provided which comprises a chamber and a transducer. The chamber receives a medium to be pumped. The chamber has first and second ends and an inlet and an outlet. The transducer is disposed at the first end of the chamber and provides an energy wave within the medium which imparts momentum to it whereby it passes through the outlet by the momentum. Further objects and advantages of the invention will become apparent to one skilled in the art from a consideration of the drawings and description of the invention.

BRIEF DESCRIPTION OF THE DRAWING

These and further features according to the present invention will be better understood by reading the following Detailed Description together with the Drawing, wherein

FIG. 5*a* is a front view of a special plano-parabolic transducer, comprised of two different piezoelectric transducer elements on a common substrate—which results in a composite frequency range much wider in spectrum that a single transducer element;

FIG. 5*b* is a cut-away perspective view of the transducer of FIG. 5*a* showing its two individual piezoelectric transducer elements having two separate resonant frequencies;

FIG. 5*c* is a resultant frequency bandwidth curve of the transducer shown in FIG. 5*b* showing how the overall frequency bandwidth is increased by this dual element plano-parabolic technique;

DETAILED DESCRIPTION OF THE INVENTION

THEORY OF OPERATION

Figure 1:
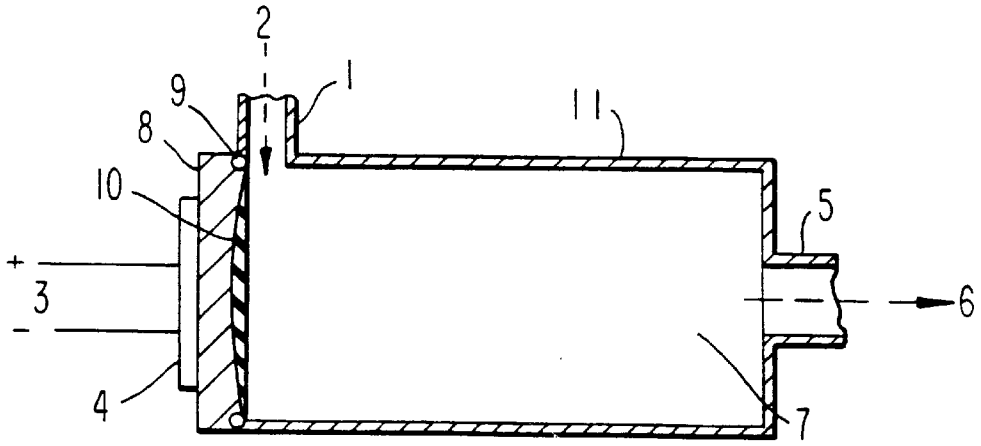
FIG. 1 is a simplified sectional side view of the basic structure of the preferred embodiment of the present invention.

A momentum transfer pump is disclosed without using any moving mechanical parts. The pump uses acoustic radiation forces to transfer momentum by elastic and inelastic collisions of phonons to the medium (fluid molecules) resulting in a flow gradient of the medium in a resultant direction opposite the acoustic energy source (transducer). It can be miniaturized; the fluid medium is totally isolated from the transducer means, and is silent with no conventional vibration.

This momentum transfer pump can be used as a direct replacement for any conventional pump application and uses far less electrical energy for an equivalent mechanical pumping operation. If it does fail in operation, it can be easily repaired by replacing the few parts needed for operation, namely either the drive electronics or the acoustic transducer itself. Furthermore, using micro-electronic circuitry, the transducer and its associated drive electronics can be integrated into one hybrid component, truly allowing for a pump system with two major parts; a-transducer assembly and the pump housing or chamber. The main housing or chamber itself can be a single molded or machined part and as such would not fail, for it is simply a metal or plastic enclosed chamber. Such a solid state pump functions via the momentum imparted by a specially designed ultrasonic transducer element. However, it may include for its operation other methods of generating ultrasonic radiation forces. To understand the mode of operation of this pump, one must consider the phenomenon of a nondissipative fluid. The medium can be treated as a continuous one. This approximation is at all times valid, except for an extremely rarefied gas, or for a solid when the wavelengths of the waves are comparable with the inter atomic distances.

If the problem can be considered one dimensional by assuming that a wave of very broad front is traveling in the positive x direction such that all motions at the coordinate value x are the same, regardless of the y and z coordinates. This type of disturbance is known as a plane wave.

When a sound wave is propagated, the particles making up the medium are displaced from their rest or equilibrium positions. If the displacement of the particle is along the line of the direction of propagation of the wave, we call the wave longitudinal. Most sound waves impacting on fluids are longitudinal in character. If these displacements are at right angles to the direction of propagation of the wave, the wave is termed transverse. Usually transverse waves are more common in very viscous liquids, but their importance in acoustics is primarily limited to sound waves in solids.

Acoustic radiation forces were first measured in 1903 and in recent years, the practical importance of acoustic measurements of this type are seen in both the nondestructive testing and medical ultrasound areas. However, a more detailed approach to these measurements arose from research done in the medical ultrasound area. The power outputs of ultrasonic transducers are measured with several parameters in mind. Usually the transducer under test is submerged in a tank of water and an ultrasonic beam emitted from the transducer is directed toward a target such as a hydrophone or a slab of rubber suspended as a pendulum. For medical applications, the measurements are made in water because the characteristic acoustic impedance of water and human tissue are similar. It is accepted that the radiation force F exerted on a totally absorbing target by an ultrasonic beam of power W is given by the equation;

$$F=W/c, \qquad \text{eq. (1)}$$

where c is the speed of sound in the medium surrounding the target. For a beam power of 1 watt, and since the speed of sound in water is 1500 m $s^{-2}$, the radiation force on an absorbing target is approximately $7\times10^{-4}$ N $W^{-1}$.

This equation is rather simple, deceptive in fact since the theory behind it is involved and has been the subject of intermittent debate since the early considerations of Lord Rayleigh and Brillouin. Some of the papers written on the theory are heavily mathematical and do not make clear the physical origin of the radiation force.

Figure 4:
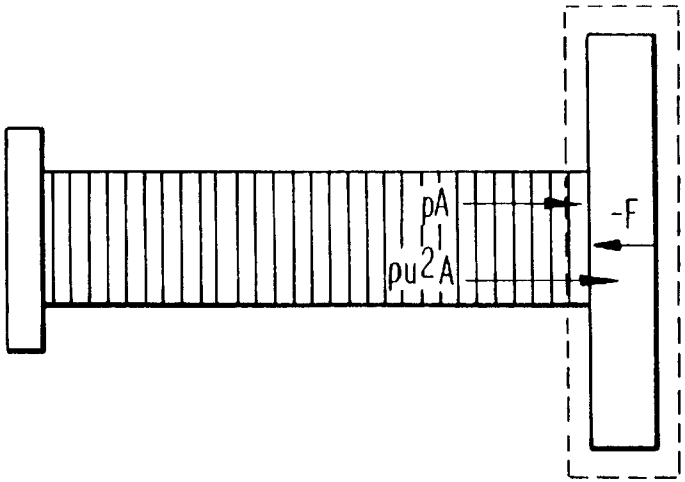
FIG. 4 is a schematic diagram illustrating how acoustic radiation pressure exerts a force on a stationary object in a control volume—for purposes of theoretical analysis.

Consider FIG. 4, where a parallel beam of ultrasound with power W is emitted from a transducer placed parallel to a target in a nondissapative fluid. Crosssectional area A of that beam propagates through this medium of density p and is incident on a totally absorbing target. However it will be assumed that a constraint force −F is applied to the target to prevent it from moving. This target is also assumed to be suspended like a pendulum, and the constraint force will be the horizontal vector component of the tension in the suspension.

When the magnitude of the constraint force is found, the radiation force will be known. To solve this problem, Euler's momentum theorem can be applied, which is a modification of Newton's second law of motion. This is applied not to a solid body, yet to a material within a fixed region of space within a moving fluid and it is stated as such:

Consider a fluid which at an instant t occupies the region of space bounded by the fixed closed surface S. In accord with Newton's second law of motion the total force acting on this mass of fluid is equal to the rate of change of momentum of the fluid. More explicitly, the resultant of the normal pressure thrusts on the surface S plus the resultant of the body forces acting on the enclosed fluid is equal to the rate of change of momentum of the enclosed fluid plus the rate of flow of motion outwards through S.

In FIG. 4, the fixed surface S is represented so that it encloses the target and the region bounded by S is referred to as the control volume. The constraint force is exerted in a direction parallel to the direction of propagation of the ultrasonic beam, and to determine its magnitude is simply a consideration of the forces and momentum in this direction. These relevant forces and rates of change of momenta to be considered are the hydrostatic pressure in the liquid which acts equally and in opposite directions through the left and right hand planes of the surface S; ergo, it may be disregarded. However, in the ultrasonic beam the sound pressure superimposed on the hydrostatic pressure exerts a force on the left hand plane of the surface S. The sound pressure in the beam at the surface is denoted by p, and the force is given by pA.

The constraint force −F is the only significant force acting on the material within the control volume.

The rate of change of momentum $\delta M/\delta t$ of the material within the control volume consists of the rate of change of momentum of the target and the rate of change of momentum of the small quantity of liquid in the control volume.

In association with the propagation of the ultrasonic beam through the surface S, there is a movement of the liquid medium forward and backward through S and therefore a transport of momentum through S. If the particle velocity in the beam at the surface S is represented as u, the momentum per unit volume of liquid at the surface is ρu, and the rate of flow of momentum inwards through a unit area of the surface is $\rho u^2$. The rate of flow into the control volume is therefore $\rho u^2 A$. From Euler's momentum theorem.

$$pA-F=(\delta M/\delta t)-pu^2A \quad \text{eq. (2)}$$

This equation describes the instantaneous balance between the forces and the rates of change of momenta in the system, and each term varies at the ultrasonic frequency. The quantity of importance to be determined is the constraint force −F. but what is strictly required is the steady constraint force −F which, on time average, is required to keep the target stationary. Note: a bar over a quantity will be used to represent a time averaged value. Equation (2) therefore is averaged with respect to time. As stated previously, the partial derivative δM/δt represents the rate of change of momentum of the target plus the rate of change of momentum of the liquid in the control volume. The target is assumed to be at rest on time average and the presence of the solid target precludes any time-averaged movement of liquid within the control volume in the direction of propagation of the ultrasonic beam.

$$\delta M/\delta t=0$$

therefore, from equation 2: $-\bar{F}=-(\bar{p}+\overline{\rho u^2})A$ is derived. Consequently the radiation force is given by $$\bar{F}=(\bar{p}+\overline{\rho u^2})A \quad \text{eq. (3)}$$

At first, it would appear difficult to accept that momentum is transferred from the ultrasound source to the fluid. The forward and reverse motion of an ultrasonic transducer that transfers movement into and out of the fluid volume element, thereby transferring momentum into and out of the fluid volume element, giving a time-averaged momentum transfer of zero. However, as the volume element of the fluid moves forward through the volume, matter enters the control volume carrying with it momentum in the direction of propagation (positive momentum), while the liquid moves backward, matter leaves the control volume carrying with it momentum in the opposite direction (negative momentum). The removal of negative momentum from the material within the control volume is equivalent to the addition of positive momentum. Further investigation shows that when considering a longitudinal wave in a fluid, one can determine that it is a conceptual decision to make; relating to how the wave will be analyzed mathematically. As with the study of longitudinal waves in fluids, it is important to determine whether to use the Lagrangian or material coordinates, or the Eulerian or spatial coordinates. If one wants to study the displacement of a specific particle from its rest position, later taking into consideration for study, its velocity and acceleration, then Lagrangian or material coordinates are used. Likewise, if one is determined to study the behavior of the fluid at a fixed point in the fluid container, specifying the displacement, velocity, and acceleration of the fluid at that point, regardless of which particles occupy the point in question at the various times in the study, then Eulerian or spatial coordinates are used. The difference between these two methods is generally of importance only when the intensity of the sound wave is very high—infinite amplitude sound or nonlinear acoustics. With interest in the area of nonlinear acoustics relating to the generation of sonoluminescence for cold fusion experiments, the realization of the difference between these two approaches is of importance. Summing this up, Lagrangian variables refer to a moving mass element of liquid and not to a fixed point in space; Eulerian variables refer to a fixed point x in space which may be occupied by different mass elements of the medium (liquid) at different times. Note: this theoretical review is referenced from an article by Deak titled, "Theory and Design Concepts of Ultrasonic Sources," COLD FUSION magazine vol. 1 number (4), September 1994.

According to a general form of the invention the responsive element of the momentum transfer pump is an ultrasonic source in general. It may, however be a specific source such as a piezoelectric transducer, an electrostriction transducer, stimulated Brillouin emission sources, surface generation in Quartz, thin-film piezoelectric transducers, depletion layer transducers, or diffusion layer transducers.

DESCRIPTION AND OPERATION OF INVENTION

In these drawings, like reference numerals are used to indicate like elements. Accordingly only those components that are different than the corresponding components are hereinafter described.

Figure 2A:
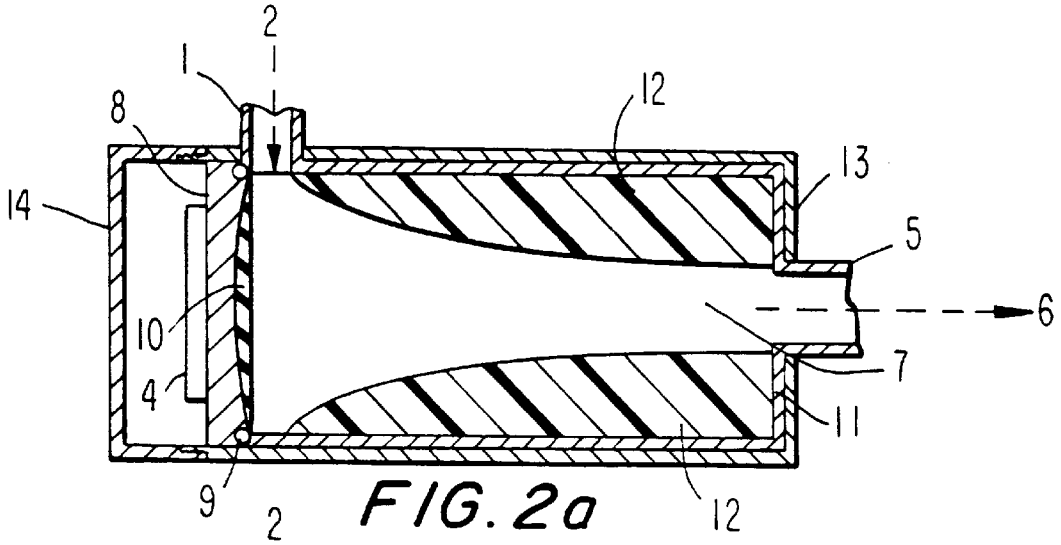
FIG. 2*a* illustrates a simplified sectional side view of the basic structure of the present invention of FIG. 1 with a well defined tapered channel used to guide a focused ultrasound beam through the medium.

The drawing of FIG. 1 illustrates a preferred embodiment of the present invention. In its broadest sense, the momentum transfer pump comprises a preferably cylindrical shaped chamber or chamber means 11 having an input port or inlet 1 for fluid entry into to the main body of the chamber 11 and an output port or outlet 5 which is disposed at the second end of the chamber 11 and which allows fluid to exit or pass from said chamber 11. Furthermore, fluid 7 contained within the chamber acts as the medium for the transfer of acoustic radiation pressure from a conventional disc shaped piezoelectric transducer element 8 having a parabolic front face plane disposed at one end, the first end, of the chamber 11, to molecules of the fluid medium 7. The transducer 8 is driven by conventional electronic drive circuitry 4 which generates electrical pulses to energize the piezoelectric transducer element 8; they form an acoustic source for providing an acoustic radiation field which emanates acoustic phonons as described in more detail below. The electronic drive circuitry 4 is connected to an electrical power source (not shown) through electrical terminals 3. A transducer means comprise the drive circuitry 4 and the transducer 8. An O-ring 9 is disposed along the periphery of the transducer 8 to prevent fluid escaping into the circuitry's housing 14 which is illustrated in FIG. 2*a*. The piezoelectric transducer 8 is electrically stimulated by the drive circuitry 4 and it in turn vibrates at its natural resonant frequency; this transducer 8 can either be of a high-Q narrow band width type, or a high-Q broadband width type; but the transducer 8 is not restricted to only these types. In the broadest sense however, the transducer 8 could, in general be any device that can effectively transform electrical energy into mechanical energy. The transducer 8 is acoustically coupled to the medium 7 by a conventional coating or acoustic coupling device 10 which enables the maximum transfer of acoustic radiation pressure into that medium 7. The radiation pattern emitted (phonons) from the transducer 8 is that of a longitudinal wave of some nature (preferably a simple harmonic wave although a complex wave can be used) and this radiation sets up a traveling wave within the chamber 11 which contains energy and momentum. As this traveling wave interacts with the medium 7 through the components of absorption, scattering, and nonlinear propagation, it transfers its energy and longitudinal momentum to the medium 7. This interaction is constant; and instantly causes pumping action to occur. The effective radiation pressure generated by the transducer 8 and coupled to the medium 7 is directly proportional to the acoustic power transmitted per unit time through a unit area of the coupling device 10, which couples the transducer energy to the medium 7. However it is also determined in part by a reflection coefficient. This reflection coefficient is determined by the ratio of the product of the density and velocity of the coupling medium 10 and the density and velocity of the fluid medium 7 to be pumped. If acoustic phonons from the transducer source 8 are totally absorbed (inelastic collisions between phonons and fluid molecules) by the medium 7, then the radiation pressure is equal to the ratio of the power emitted from the transducer 8, to the wave velocity in this medium 7; or in summary, it is equal to the energy density. If acoustic phonons from source 8 are totally reflected (elastic collisions between phonons and fluid molecules) by the medium 7, the radiation pressure is equal to the ratio of twice the power emitted from the transducer, to the wave velocity in this medium 7; or in summary, it is equal to twice the energy density. The real resultant radiation pressure falls somewhere on a time averaged value for this imparted longitudinal momentum to the medium 7. The energy per unit volume of fluid is derived from a directly proportional relationship amongst the acoustic frequency, fluid density, velocity of sound through the medium 7, the fluid particle (molecular) displacement, and further it is inversely proportional to the wavelength of the emitted acoustic wave from transducer 8. By necessary design, the acoustic coupler 10 does not interact with the emitted phonons to any significant degree and is essentially transparent to the acoustic waves; additionally it prevents any contact of the fluid medium 7 with the external environment, and this feature of the invention serves an important purpose where the absence of contamination is vital. Lack of contamination is commonly required in the medical and pharmaceutical sectors. The chamber 11 forms a non resonant cavity at the operating frequency of the transducer 8. In this embodiment the side walls of the chamber 11 are devoid of any outlets.

If the momentum transfer apparatus is utilized in a 'non-pump' mode of operation, then with the application of a complex pulse waveform superimposed upon a continuous sinusoidal waveform which is applied to excite the ultrasonic transducer; cavitation will occur. This cavitation will be established at the focal point length of the parabolic multiband transducer which is designed to reside near the end most opposite the transducer source. When cavitation occurs and when said cavitation is stimulated by a continuous wave or pulsed waves of sufficient repetition rate, sonoluminescence will take place as a direct reaction to the ultrasonic stimulus.

According to the present invention, a source of coherent blue or other spectral light results from using the ultrasonic momentum transfer pump in a special 'non-pump' mode of operation. Also, a source of coherent blue light or other spectral light results from a procedure of using a small droplet of liquid water or some other such combination of water or heavy water which is ultrasonically levitated by means of an ultrasonic levitation device as described by Deak in an article published in Infinite Energy Magazine vol. 1 No. 4 1995 titled "Applications for an Acoustic Levitation chamber." incorporated by reference. (Also in the proceedings of the First Trabzon International Energy and Environment Symposium held in Trabzon, Turkey; Jul. 28 to 31, 1996.)

FIG. 2*a* is a drawing of another embodiment of the pump which utilizes a tapered guide 12 which serves to steer the medium 7 flow gradient and the acoustic radiation in a concentrated direction which is opposite that of the transducer 8. An outer housing 13 with removable rear cover 14 is disposed over the chamber 11, transducer 8 and the drive circuitry 4. This tapered guide 12 establishes a very high radiation energy density which reduces the total chamber path length otherwise required to achieve the necessary momentum interaction.

With increased radiation energy density, non linearity of the medium 7 alters the radiation energy wave thus creating radiation harmonics. These high frequency harmonic radiation components are propagated and absorbed within the medium 7 and if the energy levels emitted from the transducer 8 are of sufficient amplitude, cavitation will occur when the rarefactive acoustic pressure results in the formation of a vapor phase of the medium in the flow gradient. Cavitation is the process of forming micro-bubbles in a liquid by generating intense ultrasound waves. When a cavity (gas or vapor bubble) is created and trapped in a fluid by an influentially strong ultrasound field, it undergoes nonlinear oscillations that can concentrate the average sound energy by over 12 orders of magnitude so as to create UV light (sonoluminescence). The history of sonoluminescence ("SL") covers more than five decades, and from previous research, sonoluminescence is well established as a branch of physics. Sonoluminescence is a non-equilibrium phenomenon in which energy in a sound wave becomes highly concentrated so as to generate flashes of light in a liquid. These flashes comprise of over $10^5$ (100,000) photons and they are too fast to be resolved by the fastest photomultiplier tubes available. Basic experiments show that when sonoluminescence is driven by a resonant sound field, the bursts can occur in a continuously repeating, regular fashion. These precise 'clock-like' emissions can continue for hours at drive frequencies ranging from sonic to ultrasonic. These bursts represent an amplification of energy by eleven orders of magnitude. During the rarefaction part of the acoustic cycle the bubble absorbs energy from the sound field and its radius expands from an ambient value Ro to a maximum value Rm. The compressional component of the imposed sound field causes the bubble to collapse in a runaway fashion (first anticipated by physicist Rayleigh about 1917). The resulting excitation (heating) of the bubble contents (surface) leads to the emission of a pulse of light as the bubble approaches a minimum radius Rc. This manifests as a 50 ps (picosecond) pulse width and peak power of 30 mW. Cavitation results from the dynamical Casimir effect wherein dielectric media are accelerated and emit light. Experiments show that just before the event of maximum bubble radius is achieved, the implosion velocity exceeds Mach-1 relative to the gas (for an acoustic period of 37.7 ns, Mach-1 is reached about 10 ns (nanoseconds) before Rc; Rc=the collapse radius); The SL light is also emitted just prior to the minimum (about 5–10 ns prior to Rc); Rm is about 40 um and Rc is about 4 um.

Consider a bubble with radius Rho and in equilibrium with hydrostatic presence PO at to=of, which will then expand isothermally in the first quarter of a period of the supersonic field. If the amplitude PA of the field is large enough, the radius of the bubble is known to expand and contract respectively around the complete pressure field cycle. The pressure field in area from Po−PA to Po+PA and the bubble contracts adiabaticaly with increasing pressure. Let Rm be a radius of the minimum bubble, when the gas filling the bubble achieves the maximum temperature Tmax.

One's interest lies with the contraction phase of the bubble where it was numerically ascertained by many authors that the contraction occurs very rapidly around the end of the third quarter of a period of the supersonic field, when the pressure field is almost Po+PA. Therefore one can describe the adiabatic contraction process by the several following equations;

$$(P_o + P_a)(V_{\max} - V_{\min}) = -\int_{V_{\max}}^{V_{\min}} P_d V, \quad PV^{\gamma} = \text{constant} \qquad \text{eq. (4)}$$

Vmax instead of directly solving the differential equation.

$$\frac{\partial^2}{\partial R^2} = -\frac{3}{2R}\left(\frac{\partial}{\partial R}\right)^2 + \frac{1}{\zeta R}\left[\left(P_o + \frac{2\sigma}{R_o}\right)\left(\frac{R_o}{R}\right)^{3\kappa} - \frac{2\sigma}{R} - \frac{4\mu\frac{\partial}{\partial R}}{R} - P_o - P_a(t)\right] \qquad \text{eq. (5)}$$

After integrating, the maximum temperature and minimum radius is obtained as follows;

$$T_{\max} = T_o Z_1^{\gamma-1}, \qquad \text{eq. (6)}$$

$$Z \equiv \left(\frac{R_{\max}}{R_{\min}}\right)^3 \approx \left[(\gamma - 1)\frac{P_O + P_A}{P_O + \frac{2\sigma}{R_O}}\left(\frac{R_{\max}}{R_O}\right)^3\right]^{\frac{1}{\gamma-1}} \qquad \text{eq. (7)}$$

if Z is much greater than unity, where To is the initial temperature. Further significance of this dynamical Casimir effect relating to the present invention will become apparent to those versed in the art once the related drawing of FIG. 10 and ensuing description of it are subsequently described. An important realization is that this cavitation which represents a vapor phase of the fluid behaves as a very good reflector of acoustic energy and this produces the maximum momentum transfer to the pumped medium 7 which is equal to twice the amount of the energy density. Therefore the generation of cavitation within the fluid is an essential component to be considered for pump operation in certain instances as described in regards to the embodiment of FIG. 9.

Figure 3:
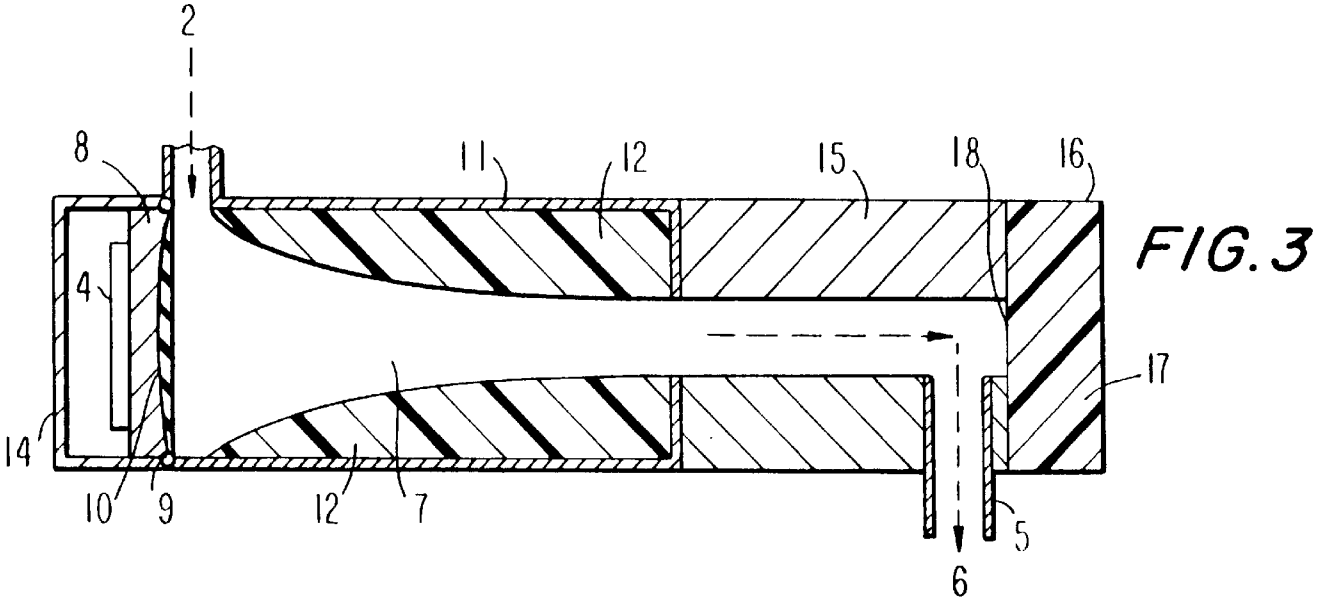
FIG. 3 illustrates a simplified sectional basic structure of FIG. 1 with a tapered focusing guide along with an extended flow zone and acoustic wave trap to prevent reflected waves from re-entering the pump chamber.

The tapered guide or tapered guide means 12 as shown in FIG. 2*a* and FIG. 3 is designed to conform to the focusing radiation pattern emitted by the transducer 8 which is preferably fabricated with a plano-parabolic front face 38 and shown on all figures except FIG. 4. The purpose of this transducer 8 design is for the focusing (concentration) of emitted acoustic energy therefrom into the medium 7 and this action allows for increased momentum transfer to the medium particles (molecules). In its simplest and broadest scheme however, the pump will function properly without a plano-parabolic face 38 transducer 8. Another variation of the transducer 8 is shown in FIGS. 5*a* and 5*b* wherein the transducer 8 is designed as a plano-parabolic type. This type of complex transducer 8 is a combination of two different parabolic transducers or transducer elements 8*a* and 8*b* each having a parabolic face plane which are fabricated on a single substrate 8*d*. Parabolic transducer 8*a* has by design a lower piezoelectric resonant frequency f8*a* than the resonant frequency f8*b* of the central parabolic transducer 8*b*. When they are both simultaneously excited by a common drive pulse or pulses, they both emit a band f8*a*L to f8*a*H and f8*b*L to f8*b*H of acoustic energy waves hovering around their respective central resonant frequencies f8*a* and f8*b* as shown in FIG. 5*c*. These two different resonant frequencies as shown in FIG. 5*c* are separated enough in value to allow for a broadbanding effect to occur whose overall resultant bandwidth as shown in FIG. 5*c* is between the lower frequency half power point f8*a*L of transducer 8*a* and the higher frequency half power point f8*b*H of transducer 8*b*. This additional design feature of transducer 8 enables a wider range of frequencies to be selected by drive circuitry 4. In fact the drive circuitry 4 is designed to generate a wide range of frequencies within this bandwidth. If one of the factors involved with momentum transfer is fluid density and particle displacement, then for different fluids optimum pumping action can be realized by simply tuning to a frequency that is corespondent to that optimized pumping action. This feature permits for the same pump to be used over a wide range of fluid viscosities without incorporating any necessary design changes. It is very important to realize that the operation of the present pump invention does not rely on any resonant cavity chamber design and therefore, no standing wave effects are utilized. This is the improvement of the present current invention over all the previously described prior art patents, and additionally has focused and dual frequency band transducer features. All of the previously prior art patents relies completely on establishing standing waves within the confines of a resonant chamber for proper operation. In the present invention, the principle of operation resides in the transfer of momentum from the energy contained in the emitted acoustic phonons from the transducer 8 to the medium 7 particles; and not the resonant frequency of the chamber, or the careful placement of the input and output ports relative to the standing wave nodes and antinodes established within the resonant chamber as is essential with all said prior art patents.

Figure 2B:
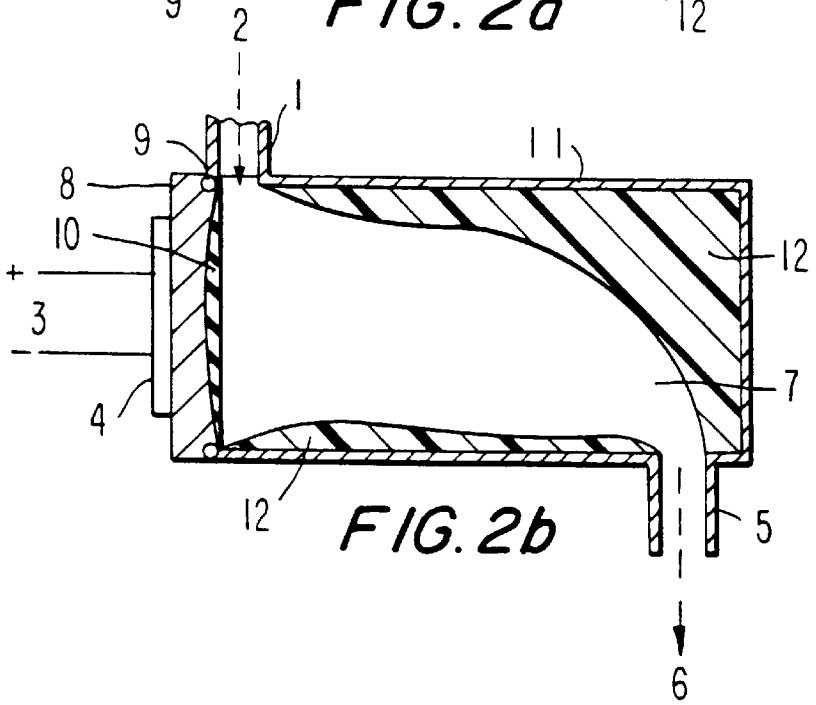
FIG. 2*b* illustrates a simplified sectional side view of another embodiment of the invention of FIG. 2*a* wherein the outlet is in the side wall of the chamber.

In FIG. 2*b*, which is a modification of the embodiment of FIG. 2*a*, the medium 7 flow gradient and the acoustic radiation generated by said transducer means 8 is steered by the tapered guide 12 which is modified for this configuration to cause medium 7 fluid flow through an output port 5 disposed in the side wall of the chamber 11 near its second end.

Referring now to FIG. 3 which shows another improved feature which clearly illustrates the lack of any connection with standing wave pumps or compressor. In said FIG. 3, a linear zone guide 15 is used to carry the medium 7 up to an acoustic wave trap or wave trap means 16 and through this zone to the output port 5. Since any acoustic wave energy not absorbed by the medium 7 is prevented from being fed back into the pump chamber 11 by the acoustic wave trap 16 and subsequently interacting with the primary pumping action and thereby reducing the overall pump efficiency. This result is achieved by use of the acoustic wave trap 16 which comprises an interior attenuation medium 17 which consists of some material with a very high acoustic absorption coefficient (i.e. oil or soft rubber) and an incident wall 18 at the second end of the chamber means 11 having a low reflection coefficient of energy transfer. The purpose of the wave trap 16 in this embodiment of the present invention, is primarily utilized to nullify any development of standing waves within the pump chamber 11 which would interfere with its proper operation. The use of a wave trap 16 and standing wave operation as in all the prior art patents discussed are mutually exclusive. In summary the wave trap absorbs and cancels any wave energy not completely absorbed by the medium 7 in the chamber 11.

Figure 6:
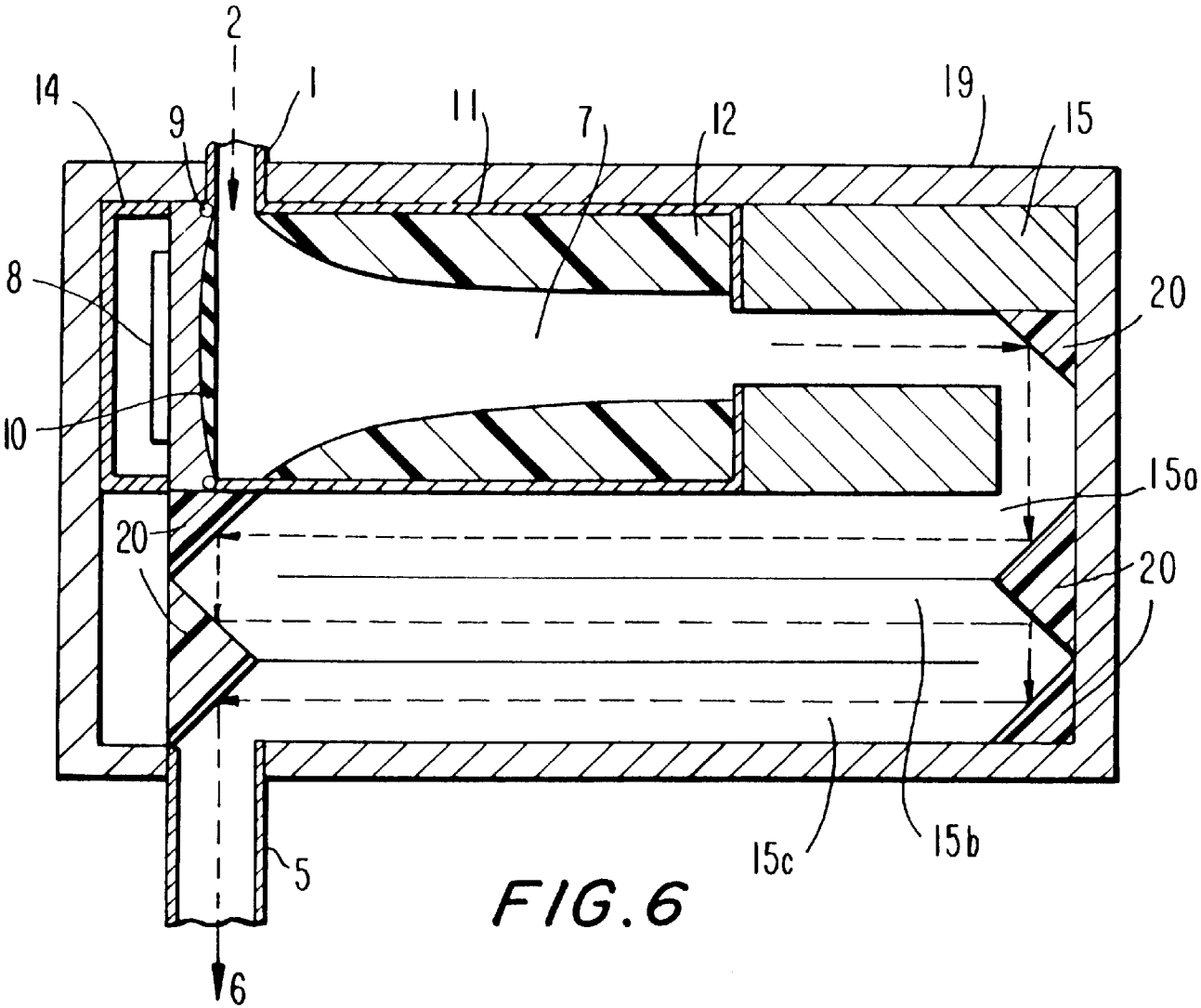
FIG. 6 shows in a simplified sectional side view another embodiment of the basic structure of the present invention with a special reflector arrangement—called an impedance transformer—for reflecting various waves of various frequencies.
Figure 7A:
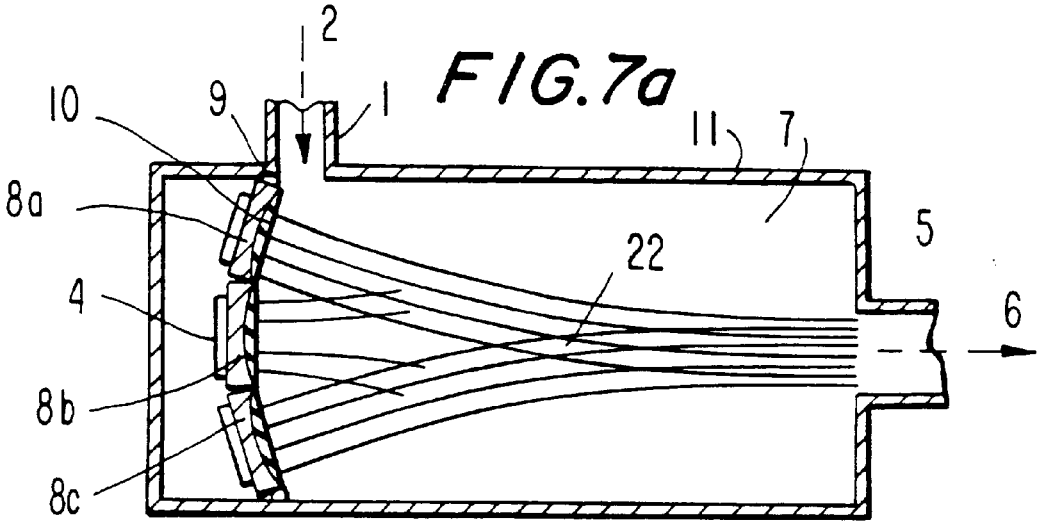
FIG. 7*a* shows in a simplified sectional side view another embodiment of the basic structure of the present invention using a multi-element transducer array with parabolic alignment for increased flow rates.
Figure 7B:
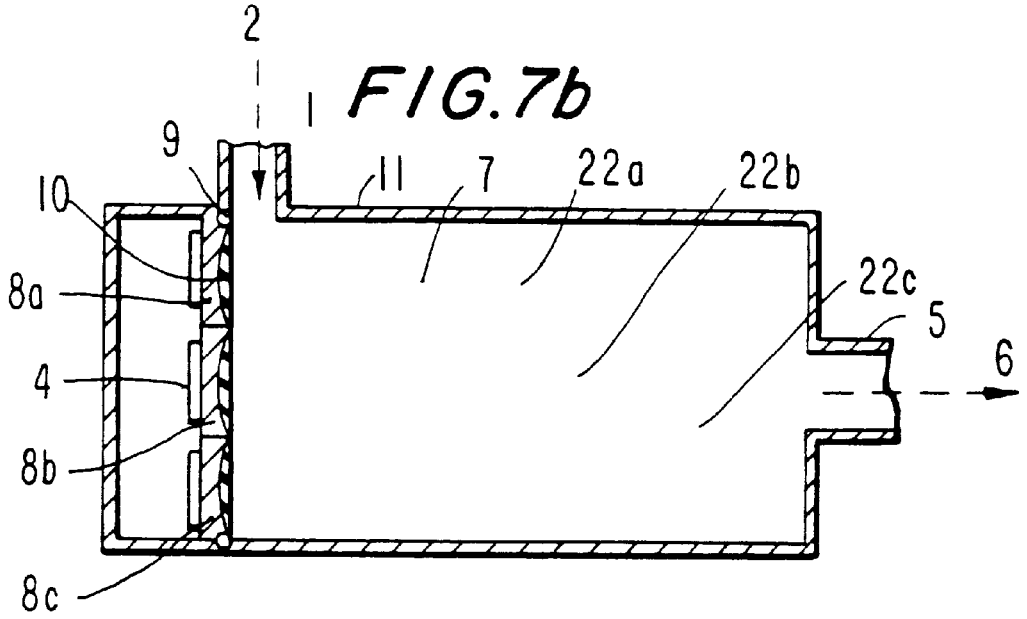
FIG. 7*b* shows in a simplified sectional side view another embodiment of the basic structure of the present invention using a multi-element transducer array with parallel plane alignment for increased flow rates.

FIG. 6 illustrates another embodiment of the present invention which extends the design configuration to encompass possible variations in pump geometry. For instance, if the pump geometry has to be confined to a certain circumscribed volume, and if the pump chamber physical dimensions are not long enough to insure complete absorption of the emitted acoustic wave energy, then a series of corner energy reflectors or energy reflector means 20 will reflect the emitted energy waves into additional linear zones or auxiliary chambers 15*a*, 15*b*, and 15*c* disposed parallel to the main pump chamber or main chamber 11; consequently, the wave energy is completely absorbed before the fluid exits the output port 5. FIG. 7*b* illustrates another embodiment of the present invention which features three transducers 8*a*, 8*b*, and 8*c* disposed in a parabolic plane so as to provide a resultant focused beam radiation field.; however this configuration is not restricted to any specific number of such transducers. The purpose of this feature of the present invention is to increase the emitted acoustic radiation pressure into the medium 7, thus producing increased flow rates to the medium 7. The alignment of this plurality of transducers 8 is not restricted to any specific alignment configuration. As shown in FIG. 7*a*, the parabolic face plane alignment configuration produces increases in the acoustic radiation pressure density pattern into the medium 7 resulting in the intensity of the acoustic radiation field being concentrated at a focal point within the medium 7. In FIG. 7*b* the emitted acoustic radiation patterns are represented by parallel lines 22*a*, 22*b*, and 22*c*; whereas with respect to the embodiment of FIG. 7*a*, the acoustic radiation pressure density pattern is represented by lines 22.

Figure 8A:
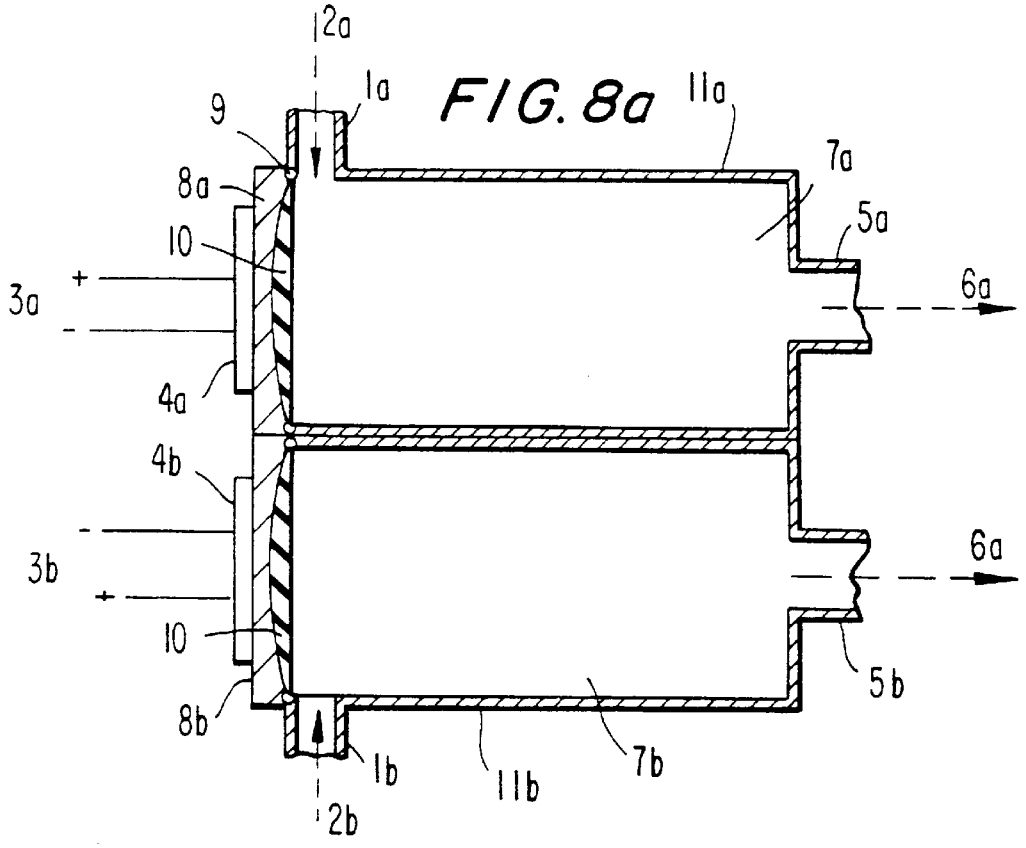
FIG. 8*a* shows in a simplified sectional side view another embodiment of the basic structure of the present invention which is multi-chambered and unidirectional and using at least one transducer per chamber, but not restricted to one transducer per chamber; to be used in complex pumping arrangements.
Figure 8B:
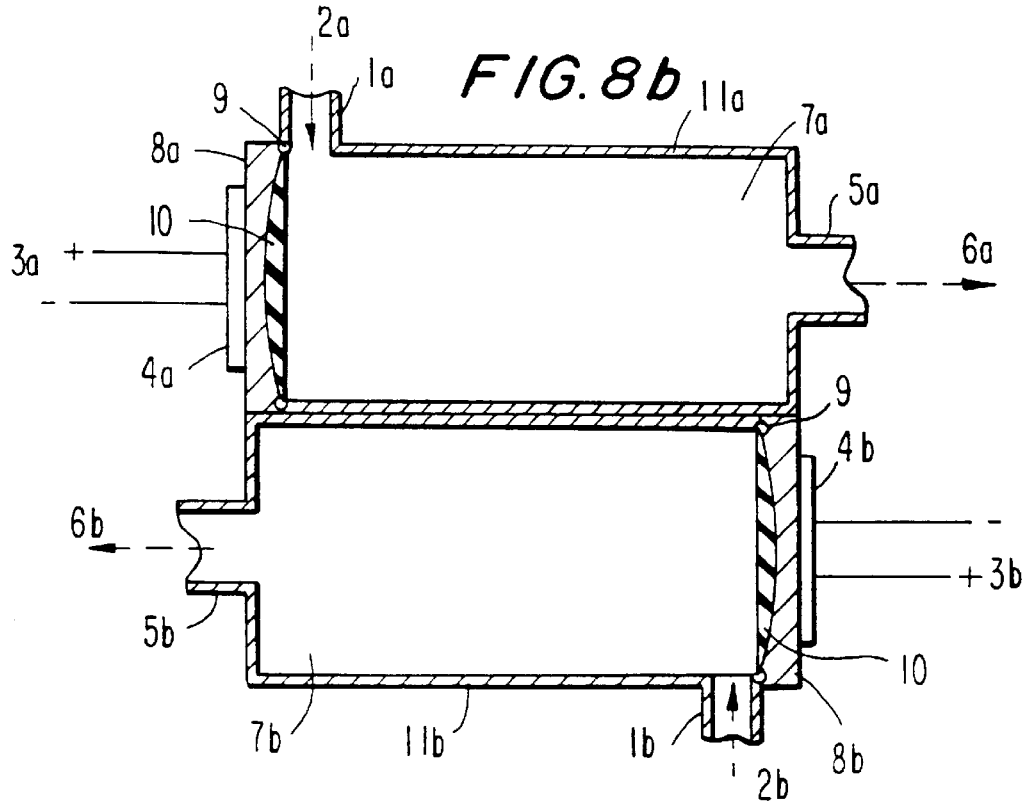
FIG. 8*b* shows in a simplified sectional side view another embodiment of the basic structure of the present invention which is multi-chambered and bidirectional and using at least one transducer per chamber, but not restricted to one transducer per chamber; to be used in complex pumping arrangements and opposite flow directions.

The present invention can also have a plurality of transducers configured as shown in FIG. 8*a* and FIG. 8*b*. Each of the plurality of transducers 8*a* and 8*b* are placed within one of the plurality of chambers 11*a* and 11*b* but not restricted to any specific combination of transducers and chambers; or specific plurality of transducers in a specific plurality of chambers.

The embodiment shown in FIG. 8*b* makes it clear that bi-directional or parallel flow is possible with this arrangement, however it is not restricted to only two different or parallel flows, but can be a plurality of directional flows or a plurality of parallel flows. The configuration of fluid flow 2*a* to 6*a* for FIG. 8*a* from chamber 11*a* is from input port 1*a* to output port 5*a*, and in a parallel direction for chamber 11*b* whose respective fluid flow 2*b* to 6*b* is from input port 1*b* to output port 5*b*.

Figure 8C:
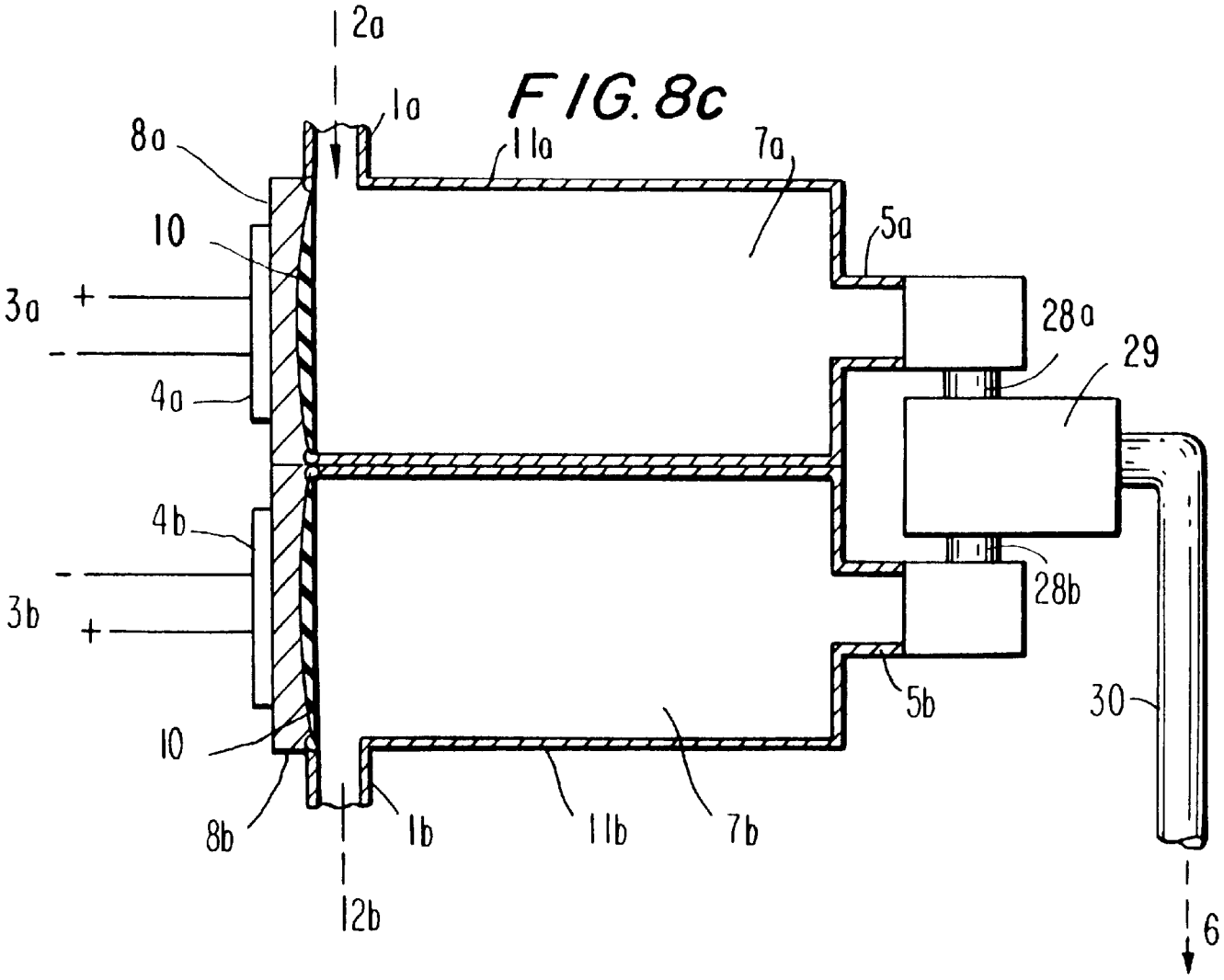
FIG. 8*c* shows in a simplified sectional side view another embodiment of FIG. 8*a* with a common mixture tank accessory.
Figure 8D:
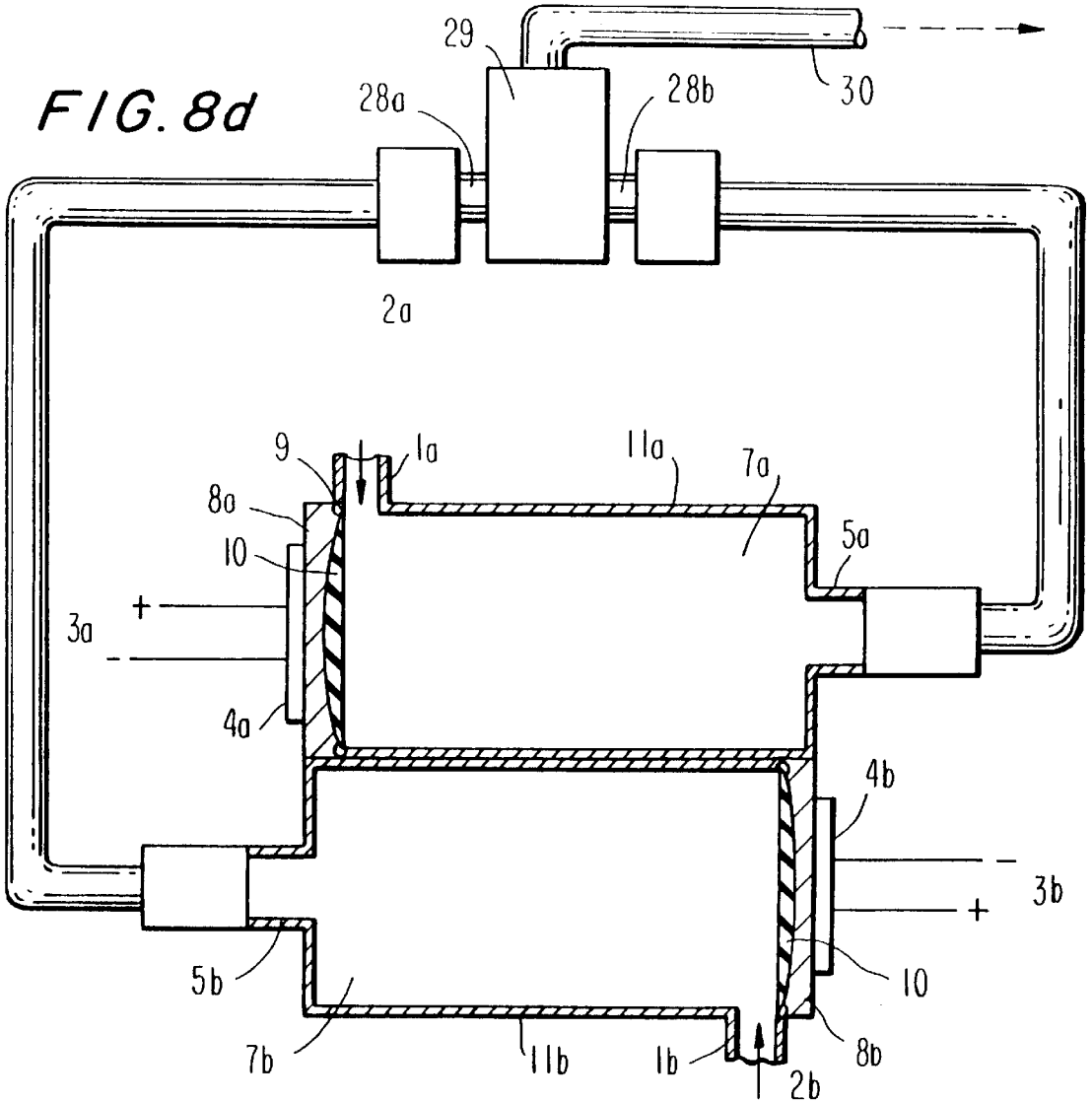
FIG. 8*d* shows in a simplified sectional side view another embodiment of FIG. 8*b* with a common mixture tank accessory.

Now referring to the embodiment of FIG. 8*b* wherein the pump chambers 11*a* and 11*b* are situated in a manner that places their respective transducers 8*a* and 8*b* in directions opposing one another. This configuration produces bi-directional fluid flow 2*a* to 6*a* and 2*b* to 6*b*. However such configuration is not restricted to only bidirectional fluid flow but it can be a plurality of different directional arrangements. An ancillary extension of the multiple momentum pump is shown in FIG. 8*c*, wherein the fluid flow 7*a* from the top chamber 11*a* travels to output port 5*a* and is further directed into the top chamber output flow and valve assembly 28*a* and the fluid flow 7*b* from the bottom chamber 11*b* travels to output port 5*b* and is further directed into the bottom chamber output flow and valve assembly 28*b*. Mixture tank or mixing chamber 29 accepts the different fluids from the top chamber output flow and valve assembly 28*a* and the bottom chamber output flow and valve assembly 28*b* where the mixture flows through a mixture output flow and valve assembly 30. FIG. 8*d* shows another embodiment, a derivation of FIG. 8*b* wherein in this configuration the opposing directional input ports 2*a* and 2*b* of FIG. 8*b* are connected to a common mixture tank or mixing chamber 29 for the purpose of mixing the different fluids.

Figure 9:
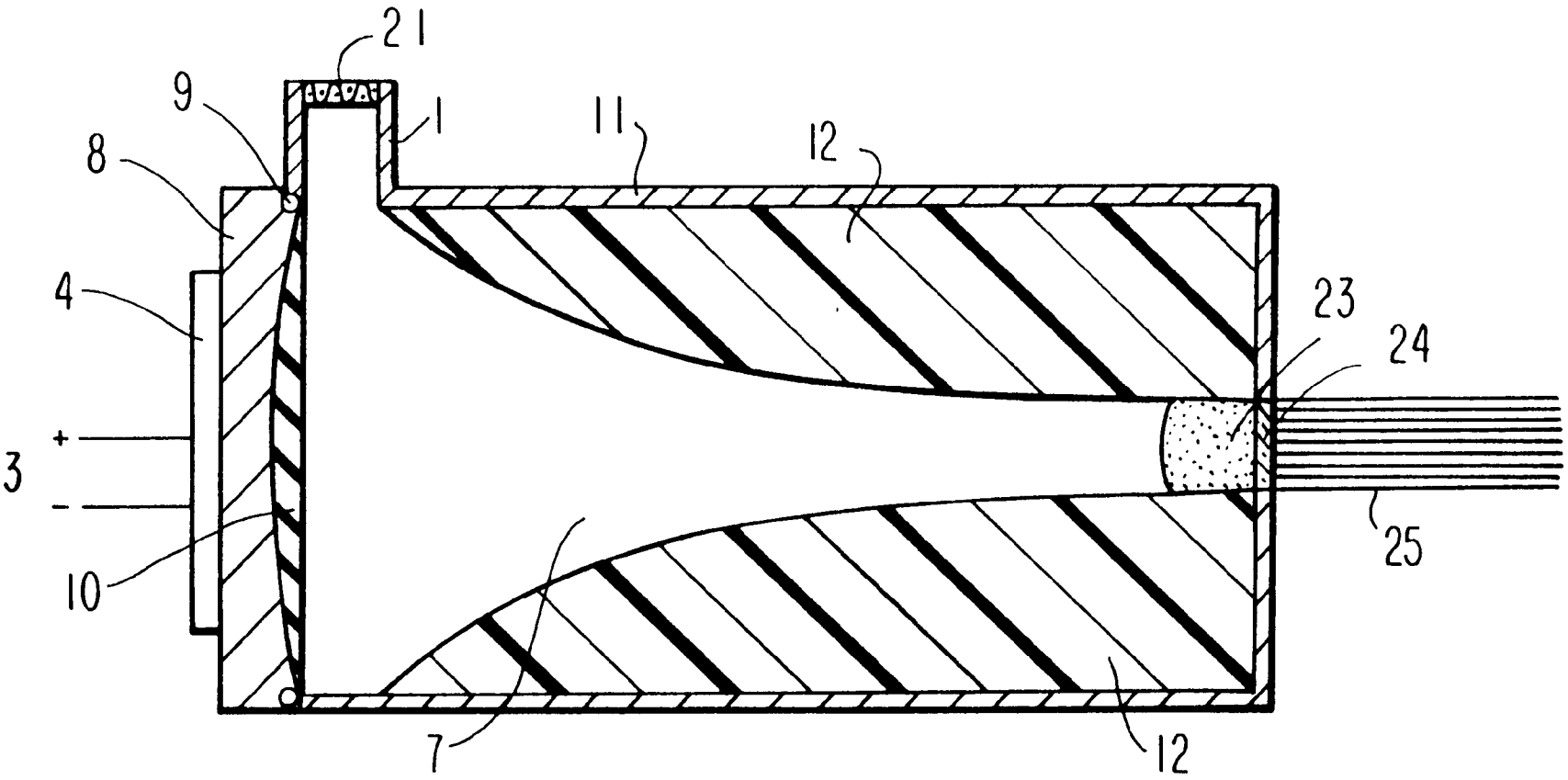
FIG. 9 is another embodiment of a pump like device which provides a special blue water laser source.

FIG. 9 represents another ancillary pump like configuration of the present invention whereby the previously configured output port 5 is replaced with a window or transparent means 24 comprised of glass or some similar transparent material. With this version of the present invention, water ($H_2O$) is used as the medium 7 and enters into the chamber 11 by way of the input port 1 and the vent and fluid input valve 21. The primary goal of this embodiment of the invention is not to have pumping action taking place; instead the water remains within the chamber for the purpose of creating cavitation within the water. In operation a very high energy density acoustic radiation pressure field is generated by an increased power pulse emanating from the drive circuitry 4 and applied to the transducer 8. The energy density is further increased by utilizing a tapered guide 12 and a parabolic transducer 8 which further concentrates the acoustic energy density. When the acoustic energy density increases beyond a certain value, cavitation occurs within the water and these micro-bubbles (cavitation) form a cluster 23 near the window 24. These micro-bubbles expand and contract in unison with the emitted ultrasound and during the collapse phase of this activity blue light is emitted through the window 24. This phenomenon is a form of coherent sonoluminescence; which stems from the dynamical Casimir effect wherein dielectric media are accelerated and emit light. A bubble in water is seen as a hole in a dielectric medium. Water is a polar molecule with a high dipole moment and responds to incident light as an oscillating dipole. If a group of water molecules is ordered into a helical structure of an axial extent greater that the wavelength of blue light where the photon energy ~3.3 eV and if the individual molecules are oriented so that the dipole moment vector of the molecules is generally pointing in the incident light direction, the group in unison is excited at the frequency of incident light. This sonoluminescence may be a highly ordered arrangement of water molecules in a liquid crystalline state scattering incident light in the Raman band. However, the sound wave is important. In the expansion, the molecular order is lost because the intermolecular spacing exceeds the range of electrostatic interaction. However, in compression the molecules are confined to a spherical geometry and the molecules are ordered into a configuration in resonance with the incident light. This blue light in phase with the ultrasonic pulsing is a cooperative lasing action. The sonoluminescence lasing action, collectively termed a blue water laser, may amplify the energy of the incident blue light because of the molecular resonance and represent an energy gain in the reflected blue light.

Figure 10:
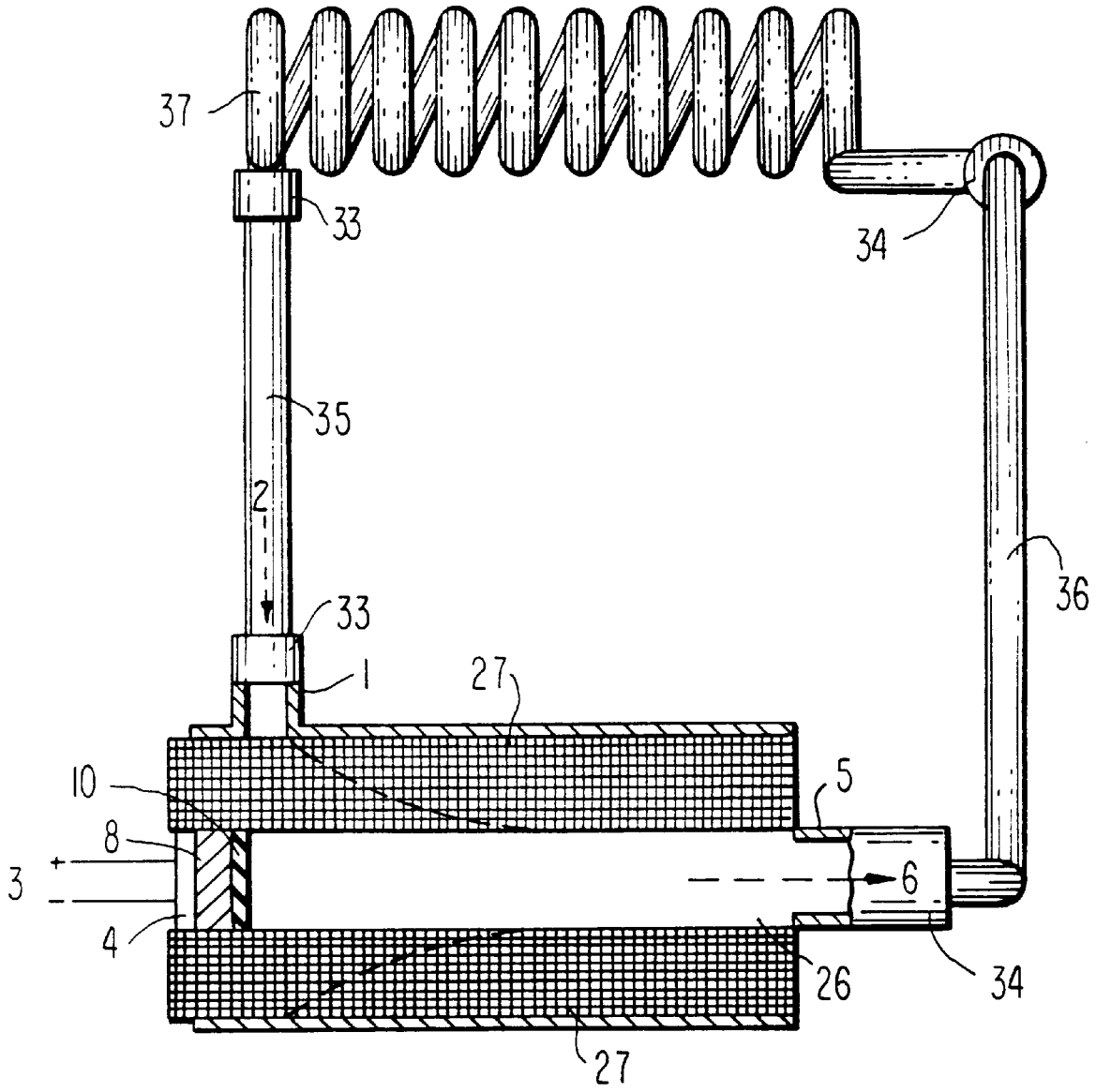
FIG. 10 shows another embodiment of the pump design which uses ultrasound to generate electricity.

FIG. 10 represents another embodiment of this invention, namely a method of generating an electrical current within a liquid metallic medium 26. The premise for operation of this apparatus relating to the present invention utilizes a liquid metallic medium 26 which is made to flow by the previous methods set forth in the above descriptions of FIGS. 1–8.

An external electromagnetic field coil 27 is wound around the outside of the chamber 11 and an electromagnetic field is established throughout the liquid metallic medium 26 therein. It should be apparent that for any number of design considerations either an electromagnetic field coil 27 could be used or a permanent magnetic field can be used; both provide a magnetic means. However there is no restriction on the present invention to the number of electromagnetic fields or permanent magnetic fields established for this or any other purpose of the invention. As the acoustic energy is emitted from transducer 8 there is a flow gradient set up within the liquid metal medium 26 and as this liquid metal medium flows through the electromagnetic field created by field coil 27 and an electric current is induced therein by the field coil 27 which begins to flow within the liquid metal medium 26. The flow of this induced electric current is in the same direction of the pumped fluid flow 6 and travels through a connecting means connected between the outlet 5 and the inlet 1. The connecting means loop is through a first nonmetallic or metallic valve 32 and also through the nonmetallic or metallic output tubing 34 and in turn continuing on through a second nonmetallic or metallic valve 32. It then passes into the nonmetallic or metallic coiled tubing 35, where it cycles out through a nonmetallic or metallic valve assembly 31 where it eventually passes through nonmetallic or metallic tubing 33 and to inlet valve 31 which is the initial reentry point for a new cycle of flow. With this embodiment of the present invention a single transducer 8 is used but a plurality of transducers 8 can be incorporated for various design reasons. Likewise there could be a plurality of chambers incorporated for various design reasons, or any combination of a plurality of transducers and a plurality of chambers with a plurality of electromagnetic fields 27 or a plurality permanent magnetic fields for various design reasons. It should be apparent to anyone skilled in such art that a plurality of non-metallic or metallic coiled tubing arrangements could be used in conjunction with a plurality of transducers and a plurality of chambers with a plurality of electromagnetic fields 27 or a plurality of permanent magnetic fields for any possible design configuration or configurations.

In summary, the above described embodiment utilizes a pump as described previously; which pump is surrounded by an externally generated magnetic field for the purpose of providing magnetic lines of force directly through the chamber means 11. The pump fluid medium 26 is a liquid metal and as it moves through the magnetic field it creates an electric current flow through the liquid metal. Such an embodiment, using ultrasound energy, can be used to generate electricity.

Although various embodiments of the present invention have been described and illustrated herein, it is recognized that modifications and variations may readily occur to those skilled in the art.

What is claimed is:

1. Apparatus for generating luminescent energy from a liquid medium comprising:

a tapered chamber having a larger and a smaller end, and a longitudinal path therebetween;

a transparent window disposed at said smaller end to permit light to pass there through; and transducer means disposed at said larger end for providing a traveling acoustic wave along said path of sufficient energy to enable cavitation to form in said liquid medium at the smaller end of said chamber with an emission of light provided by sonoluminescence.

2. The apparatus of claim 1, wherein said medium comprises a degassed liquid, and said transducer means comprises means for establishing within the volume of said chamber a cavity of one of a micro-bubble and a vapor.

3. The apparatus of claim 2, further comprising means for stimulating a change in at least one parameter comprising pressure, temperature, shape and volume of said micro-bubble and said vapor, said means for stimulating comprising means for directing a controllable radiant energy through said medium onto said micro-bubble and said vapor.

4. The apparatus of claim 3, wherein said controllable radiant energy comprises an amplitude-modulated laser including at least one of a sonic and an ultrasonic modulation means.

5. The apparatus of claim 4, wherein said amplitude-modulated laser selectively initates and controls the sonoluminescence of said micro-bubble and vapor.

6. The apparatus of claim 2, further comprising means for selectively energizing said transducer, wherein said one of said micro-bubble and said vapor is levitated within said chamber according to said selective energization of said transducer.

7. A method of generating light in a liquid medium, comprising the steps of:

providing a travelling first acoustic wave into a selected region in said liquid medium; and providing a selectively varied second acoustic wave to said selected region, wherein sonoluminescent generation of light energy is provided.

* * * * *